US010569323B2

(12) United States Patent
Pons Bertran et al.

(10) Patent No.: US 10,569,323 B2
(45) Date of Patent: Feb. 25, 2020

(54) LOADING BLANKS TO A STAMPING PRESS LINE

(71) Applicant: ABB SCHWEIZ AG, Baden (CH)

(72) Inventors: Roger Pons Bertran, La Torre de Claramunt (ES); Ramon Casanelles Moix, Sant Cugat del Vallés (ES)

(73) Assignee: ABB SCHWEIZ AG, Baden (CH)

( * ) Notice: Subject to any disclaimer, the term of this patent is extended or adjusted under 35 U.S.C. 154(b) by 431 days.

(21) Appl. No.: 15/502,265

(22) PCT Filed: Aug. 7, 2014

(86) PCT No.: PCT/EP2014/066971

§ 371 (c)(1),
(2) Date: Feb. 7, 2017

(87) PCT Pub. No.: WO2016/020001

PCT Pub. Date: Feb. 11, 2016

(65) Prior Publication Data

US 2017/0232496 A1 Aug. 17, 2017

(51) Int. Cl.

| | |
|---|---|
| ***B21D 43/24*** | (2006.01) |
| ***B65H 1/30*** | (2006.01) |
| ***B21D 22/02*** | (2006.01) |

(52) U.S. Cl.

CPC ..... *B21D 43/24* (2013.01); *B21D 22/02* (2013.01); *B65H 1/30* (2013.01)

(58) Field of Classification Search

CPC . B65H 1/263; B65H 1/30; B65H 3/50; B65H 3/60; B65H 3/48; B65H 3/16;

(Continued)

(56) References Cited

U.S. PATENT DOCUMENTS 1,716,602 A * 6/1929 Ross ..... B21D 43/24 209/215
4,768,913 A 9/1988 Baba (Continued)

FOREIGN PATENT DOCUMENTS

CN 200945511 A 9/2007
CN 200945511 Y 9/2007

(Continued)

OTHER PUBLICATIONS

The American Heritage Dictionary Second College Edition, 1982, p. 1067 definition of robot (Year: 1982).*

(Continued)

*Primary Examiner* — David H Bollinger
(74) *Attorney, Agent, or Firm* — Peter B. Scull; HDC IP Law LLP

(57) ABSTRACT

A method for loading blanks to a head of the stamping press line includes providing a stack of blanks at a pick-up position; loading blanks from the stack of blanks to the head of the stamping press line; before the stack of blanks is exhausted, creating a buffer by raising a predetermined number of blanks from the top of the stack to a position above the stack; and loading blanks from the buffer to the line while replacing the stack of blanks with a new stack of blanks. A handling system for creating a buffer includes one or more buffer robots with one or more supporting tools on which the blanks can be held, and one or more separating tools to separate one or more blanks at the top of the stack from the underlying blank of the stack.

19 Claims, 5 Drawing Sheets

(58) Field of Classification Search
CPC ..... B65H 3/14; B65H 3/0816; B65G 59/02; B65G 59/023; B65G 59/04; B65G 61/00; B65G 65/02; B21D 43/24; B21D 22/02
USPC ..... 271/18.1, 18.2; 414/797.1, 796.5, 796.9, 414/795.5, 795.8; 901/40
See application file for complete search history.

(56) References Cited

U.S. PATENT DOCUMENTS

| | | | |
|---|---|---|---|
| 5,564,893 | A | 10/1996 | Tacchi et al. |
| 5,611,658 | A | 3/1997 | Olofsson et al. |
| 6,006,638 | A | 12/1999 | Eltringham |
| 6,468,025 | B1 | 10/2002 | Stumpf et al. |
| 6,682,065 | B2 | 1/2004 | Leonarde et al. |
| 8,530,776 | B2 | 9/2013 | Dieterich et al. |
| 2005/0036881 | A1 | 2/2005 | Eriksson et al. |
| 2010/0266380 | A1 | 10/2010 | Dorner et al. |

FOREIGN PATENT DOCUMENTS

| | | | |
|---|---|---|---|
| CN | 102070028 | A | 5/2011 |
| EP | 0582093 | A1 | 2/1994 |
| EP | 0780172 | A2 | 6/1997 |
| EP | 2195267 | B2 | 3/2011 |
| FR | 1299879 | A | 7/1962 |
| FR | 2948311 | A1 | 1/2011 |
| GB | 966329 | A | 8/1964 |
| JP | S58138529 | A | 8/1983 |
| JP | S61166439 | A | 7/1986 |
| JP | H07137843 | A | 5/1995 |
| JP | H07506798 | A | 7/1995 |

OTHER PUBLICATIONS

First Notification of Office Action (PCT Application Entered Into the National Phase), Chinese Application No. 201480081330.6 issued by the China National Intellectual Property Administration, Beijing, China, dated Jun. 4, 2018.

Apparent English language translation of the First Notification of Office Action (PCT Application Entered Into the National Phase), Chinese Application No. 201480081330.6 issued by the China National Intellectual Property Administration, Beijing, China, dated Jun. 4, 2018.

International Search Report and Written Opinion of the International Searching Authority, Search Report, Application No. PCT/EP2014/066971 (pub. No. WO2016020001) issued by the European Patent Office, Rijswijk, Netherlands, dated Apr. 8, 2015.

* cited by examiner

LOADING BLANKS TO A STAMPING PRESS LINE

The present disclosure relates to methods for loading blanks to a stamping press line, and to handling systems for creating a buffer from a stack of blanks when loading blanks to a stamping press line.

BACKGROUND

In the production of stamped or pressed metal parts, stamping press lines may be supplied with metal blanks that have previously been cut from a metal coil in a separate blanking line. The blanks may be shear-cut metal blanks of a predetermined length or they may be contoured blanks cut with a blanking die.

It is well known the use of industrial loading robots for loading blanks in a stamping press line, such as those for manufacturing vehicle body parts.

In the stamping press lines, the blanks are collected from a stack of blanks by a loading robot which feeds the blanks to the stamping press line. The blanks at the top of the stack e.g. blanks made of magnetic material may be maintained slightly separated from each other at least at the edges, for example by magnets, to prevent them from adhering to each other and thus preventing the loading robot from picking more than one blank, which would cause serious problems in the press.

In recent years, the stamping press lines have been improved and modernized and, therefore, the capacity of the stamping press line to process blanks has been enhanced.

However, the efficiency of the line requires that there is no interruption of the feeding process when the stack is consumed and must thus be replaced by a new stack of blanks. This may lead to undesirable down times in the feeding of the stamping press line.

A known solution in robot lines to avoid down times is providing two stacks of blanks at two different pick-up positions, such that blanks may be taken from one stack, while the other is being replaced.

A problem of this solution may be that the number of loading robots is increased e.g. one robot for each stack of blanks, thus costs may be increased as well. Furthermore, the operative space for each loading robot may be reduced, thus loading robots may be situated in a position far from the pick-up point and therefore, the loading cycle may be slowed down.

In this way, it would be desirable to provide a more flexible solution that allows working with a single stack, and at the same time avoid down times when the stack is exhausted. Furthermore, the number of loading robots may be maintained in a reasonable number.

SUMMARY

In a first aspect, a method for loading blanks to a head of a stamping press line is provided. The method includes: providing a stack of blanks at a pick-up position; loading blanks from the stack of blanks to the head of the stamping press line; before the stack of blanks is exhausted, creating a buffer by raising a predetermined number of blanks from the top of the stack of blanks to a position above the stack of blanks and loading blanks from the buffer to the head of the stamping press line while providing a new stack of blanks at the pick-up position.

Creating a buffer of blanks above the stack of blanks allows working with a single stack of blanks and a single pick-up position (in the x-axis and the y-axis), and at the same time it allows loading the blanks from the buffer to the head of the stamping press line during the time needed to replace the consumed stack of blanks with a new one, thus allowing the change of stack without down times.

The buffer may typically be created with the last blanks at the bottom of the stack of blanks, when only a few blanks remain. The predetermined number of blanks of the buffer may be selected depending on the speed of the stamping press line and the time needed to replace the stack of blanks, so that the buffer is sufficient to avoid any stop in the loading process.

In some examples, raising a predetermined number of blanks is performed by one or more buffer robots, each buffer robot having one or more supporting tools on which the blanks can be held.

The use of robots for creating the buffer may have the advantage that the operation of the robots can be adapted to work with blanks of different sizes and shapes. In some implementations, the supporting tool itself may also be adapted to the shape of the blanks.

The need to change the devices employed to create a buffer depending on the shape of the blank may be avoided, thus the operation of the system may be improved.

In a second aspect, a handling system is provided for creating a buffer from a stack of blanks, the system including one or more buffer robots. Each buffer robot may have one or more supporting tools on which the blanks can be held, and one or more separating tools configured to separate one or more blanks at the top of the stack of blanks from the underlying blank of the stack of blanks.

The system allows creating a buffer above the stack of blanks before the stack is exhausted, thus allowing continuous working of the stamping press line using only one stack of blanks. Furthermore, the flexibility of the robots may allow creating the buffer by taking blanks from any desired height of the stack, and therefore it makes it unnecessary for example to place the stack of blanks on a lifting support, although this is also possible.

The same buffer robots may be used to maintain the top blanks separated from each other and may also be provided with the supporting tools to create the buffer, thus space may be saved and the cost of extra robots may be avoided.

In a third aspect, a method for loading blanks to a head of a stamping press line may be provided. The method may include: a stack of blanks may be provided at a pick-up position; blanks from the stack of blanks may be loaded to the head of the stamping press line using a loading robot; During the time-outs in the feeding of the head of the stamping press line, a buffer of blanks may be created by separating a predetermined number of blanks from the top of the stack of blanks and placing them to a buffer holder using the loading robot; the blanks of the buffer may be loaded to the head of the stamping press line while providing a new stack of blanks at the pick-up position.

In a fourth aspect, a handling system for creating a buffer from a stack of blanks may be provided. The handling system may include: a loading robot; and a buffer holder configured to receive one or more blanks, wherein the buffer holder may have one or more separating tools configured to separate one or more blanks at the top of the stack of blanks from the underlying blank of the stack of blanks.

Additional objects, advantages and features of embodiments of the invention will become apparent to those skilled in the art upon examination of the description, or may be learned by practice of the invention.

BRIEF DESCRIPTION OF THE DRAWINGS

Non-limiting examples of the present disclosure will be described in the following, with reference to the appended drawings, in which.

DETAILED DESCRIPTION

Figure 1:
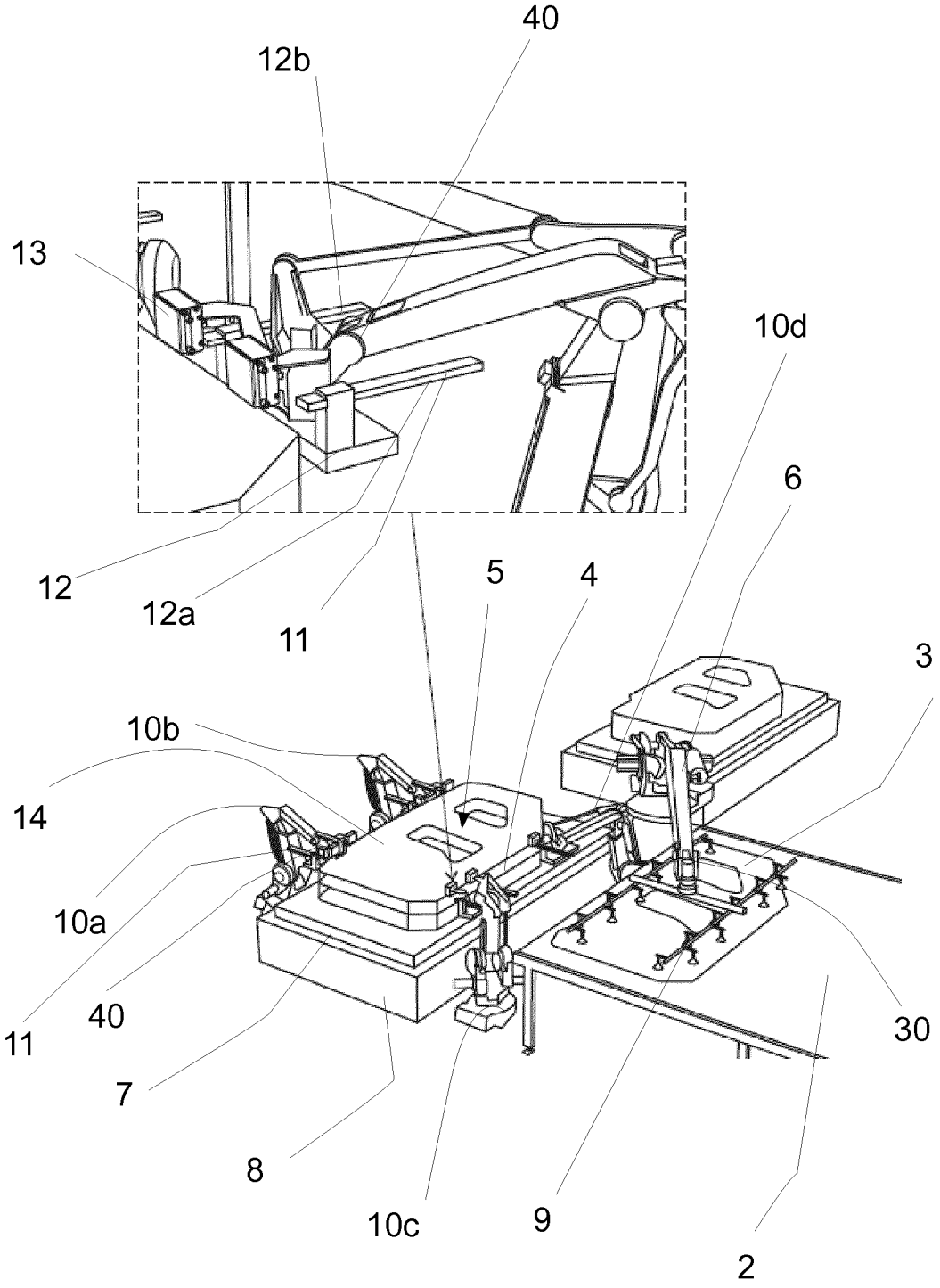
FIG. 1 is a perspective view of a loading station of a head of a stamping press line with a handling system for creating a buffer from a stack of blanks.

FIG. 1 shows a handling system according to an implementation of the present developments, in a loading station of a head of a stamping press line.

More particularly, FIG. 1 shows very schematically a head of a stamping press line 2, such as a press line, which may receive a blank 3 from a stack 4 of blanks located at a pick-up position 5.

A loading robot 6, for example a suitable industrial robot, may pick up the blank 3 at the top of the stack 4 and feed it to the head of the stamping press line 2. In the position shown in FIG. 1 the robot 6 is placing a blank 3 at the beginning of the head of the stamping press line.

The stack 4 of blanks may be located on a stacking support 7 configured to hold the stack of blanks. The stacking support 7 is shown only schematically in the figures, and may be of any known type.

In this example, the stack 4 of blanks may be one stack of blanks although some other options may be possible. For example, the stack of blanks may be formed with a plurality of stacks of blanks. In this way, the plurality of stacks of blanks may be situated on the stacking support. The plurality of stacks of blanks may be situated parallel to each other in the direction of the flow of the press stamping line although some geometrical distributions may be possible. In the particular case of two stacks of blanks, the operation of the systems may be described as follows: the loading robot 6 may pick up a first blank situated at the top of the first stack of blanks and a second blank situated at the top of the second stack blanks simultaneously. The stamping press line may be fed with the first and second blanks at the same time, thus the feed rate of the line may be increased.

The stacking support 7 may include a carriage 8 that may be displaceable along a track (not shown). The carriage 8 may be driven by a linear motor (not shown) but other options may be possible. The stacking support 7 may be provided with load detector (not shown) to detect that the stack 4 of blanks is exhausted, or that only a predetermined number of blanks remain.

The loading robot 6 may be provided with four axes or six axes. The loading robot may include a wrist mount 30 located at its distal end. A tooling 9 e.g. with magnet or suction cups suitable for handling the blank 3 may be attached to the wrist mount 30. The loading robot 6 may be mounted on the floor but some other configurations may be possible, e.g. roof mounted.

The loading robot 6 may be controlled by a controller (not shown) to pick up the blank 3 from the stack of blanks 4 and load it on the head the stamping press line 2.

An example of a loading robot that may be employed in the loading station of FIGS. 1, 2, 3 and 4 is robot IRB 6660 or IRB 760, available from ABB (www.abb.com), among others.

The pick-up position 5 where the blanks 3 may be picked may be located aligned with the head of the stamping press line 2, as shown, but other pick-up positions may be possible.

As will be described in more detail below, during the loading of blanks from the stack 4 to the head of the stamping press line 2, and before the stack 4 of blanks is exhausted, a handling system may operate to create a buffer of blanks, from the stack 4 of blanks, by raising a predetermined number of blanks to a position above the rest of the stack 4, or above the stacking support 7. The buffer may then be employed to feed the head of the stamping press line 2 by robot 6, while a new stack of blanks is provided at the pick-up position, below the buffer. This means that the loading operation may continue at normal speed while an exhausted stack of blanks is replaced, thus avoiding down times.

The buffer may be created with the blanks remaining at the bottom of the stack when the latter is almost exhausted. Depending on the time required to provide the new stack of blanks and on the speed of the head of the stamping press line 2, the buffer may be created for example with a predetermined number of between two and ten blanks.

The handling system for creating the buffer may include one or more suitable industrial robots, which will be referred herein as "buffer robots", to indicate their function.

In the implementation shown in FIG. 1 the handling system includes four buffer robots 10*a*, 10*b*, 10*c* and 10*d*. An example of an industrial robot suitable to be employed as buffer robot in such a handling system is IRB 260 or IRB 460, available from ABB (www.abb.com), among others.

Each buffer robot 10*a*, 10*b*, 10*c* and 10*d* may be provided with a wrist mount 40 located at its distal end. A supporting tool 11 may be attached to the wrist mount 40 of each buffer robot 10*a*, 10*b*, 10*c* and 10*d*. The supporting tool 11 is intended to be movable between a retracted position, in which it does not interfere with the stack 4 of blanks, and an extended position, in which it is inserted under one of the blanks of the stack 4, such that the blanks above the supporting tool 11 may rest and be supported thereon.

Typically the supporting tool 11 may be inserted under the lowermost blank of the stack 4, so as to create the buffer with the blanks remaining at the bottom of the stack 4. This allows using up all the blanks on the stack 4, and facilitates the insertion of the tool: for example the stacking support 7 may be provided with suitable recesses or channels (not shown) for inserting the tool 11 under the lowermost blank of the stack 4.

In the example shown in FIG. 1 (see in particular the enlarged detail), the supporting tool 11 may include a housing 12 and two parallel arms or rods 12*a* and 12*b*, which are slidably mounted with respect to the housing 12 between the retracted position, in which they do not interfere with the stack 4 of blanks, and the extended position, in which they are inserted under one of the blanks of the stack 4, such that the blanks above the arms 12*a*, 12*b* may rest and be supported thereon. In FIG. 1, the arms 12*a*, 12*b* of the supporting tool 11 are shown in the retracted position.

Other implementations of the supporting tool are possible. For example, a supporting tool may be separate from the robot, and may be picked up by the robot when the buffer has to be created, and dropped off again when the buffer is exhausted and the normal loading operation from the new stack of blanks is resumed. In other implementations, suitable supports may be provided under the stack of blanks, for example horizontal bars projecting from the sides of the stack, and the buffer robots may have supporting tools configured as grippers or otherwise adapted to engage the sides of the supports to raise the blanks.

A separating tool 13, e.g. a magnetic device, may also be provided on each buffer robot 10*a*, 10*b*, 10*c*, 10*d*. The magnetic device creates a magnetic field, thus the blank situated on the top of the stack may be slightly separated from the underlying blank of the stack of blanks 4.

For example, the blank at the top of the stack 4 that is prepared to be picked by the robot 6 may be slightly separated from the second blank, usually along its edges: in this way, the pickup of the blank 3 by the loading robot 6 may be improved, because there is less risk that the top blank drags or displaces the underlying blank when being lifted by the loading robot 6.

The separating tool may be magnetic, as described above, but other implementations are possible. For example, in the case of blanks on non-magnetic materials such as aluminum, the tool may inject air between the blanks to separate them, or may combine both a magnetic and a pneumatic effect. Another option may be to apply a mechanical friction force in an upward direction on the upper edge of the blank that is at the top of the stack, so as to lift it slightly, in this case, the mechanical friction may be applied to both magnetics and non-magnetics blanks.

In the implementation of FIG. 1 the separating tool 13 (see enlarged detail) is shown attached to the same housing 12 of the supporting tool.

A sensor system (not shown) may also be provided, to determine the position of the stack, in height and/or in horizontal position, such that for example the separating tools may be applied in the correct position of the stack.

The plurality of buffer robots 10*a*, 10*b*, 10*c* and 10*d* may be controlled jointly, such that the buffer robots may act simultaneously on the blank(s) 14 to separate it from the stack of blanks 4.

Control units that may operate robots jointly are for example those available from ABB (www.abb.com) which include the function MultiMove; MultiMove is a function embedded e.g. into ABB's IRC5 control module, that allows control of the axes of several manipulators such that they work like a single robot.

An implementation of the method for loading blanks to the head of the stamping press line 2 that employs a handling system will now be described with reference to FIGS. 1 to 4.

In FIG. 1, the loading robot 6 is picking blanks 3 from the stack 4, and the supporting tools 11 are in the retracted position, i.e. not interacting with the blanks. The plurality of buffer robots 10*a*, 10*b*, 10*c* and 10*d* may have the separating tools 13 activated, thus the blank situated on the top of the stack 4 of blanks may be maintained slightly. The loading robot 6 may pick up the blanks from the top of the stack 4, and the head of the stamping press line 2 may be fed.

As blanks are removed from the stack 4, and unless the stacking support 7 is provided with a lift, the height of the stack 4 will decrease; the buffer robots 10*a*, 10*b*, 10*c*, 10*d* may then progressively adjust the position of the separating tools 13 to the stack height.

The number of blanks remaining on the stack 4 may be controlled, for example by a load detector (not shown); alternatively, the number or remaining blanks may be determined depending on the height of the buffer robots 10*a*, 10*b*, 10*c*, 10*d*, because these robots place the separating tool adjacent the blank at the top of the stack, so their height at any time depends on the number of remaining blanks.

When only a predetermined number of blanks remain on the stack 4, the handling system may be operated to create a buffer with these blanks. For this, the buffer robots 10*a*, 10*b*, 10*c*, 10*d* may place the supporting tools 11 at the bottom of the remaining stack, and the tools 11 may be moved to the extended position. As a result, the arms 12*a*, 12*b* may be displaced under the lowermost blank of the stack 4.

The buffer robots 10*a*, 10*b*, 10*c*, 10*d* may then operate to raise the blanks that are resting on the supporting tools 11 to a position above the stacking support, and above the height of a complete or full stack of blanks.

Figure 2:
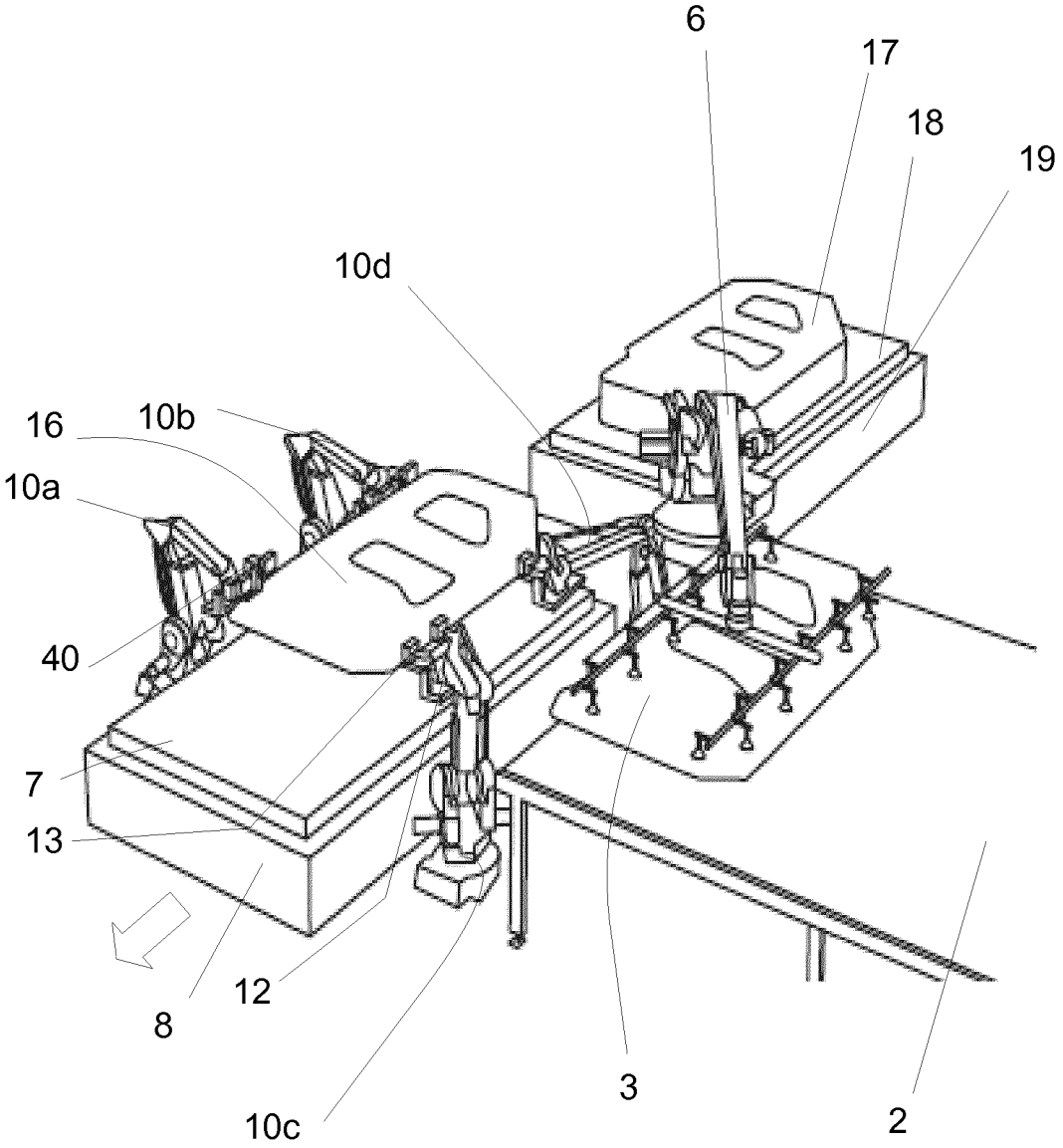
FIG. 2 is a perspective view of the loading station of FIG. 1, showing the handling system creating a buffer.

FIG. 2 shows this position. The blanks held by the supporting tools 11 create a buffer 16 of blanks, from which the loading robot 6 may pick blanks to feed the head of the stamping press line 2, while the stacking support 7, where no blanks remain, is displaced from the pick-up position 5 as shown by the arrow in FIG. 2.

The empty stack of blanks may be replaced with a new stack 17 of blanks, which in FIG. 2 is shown prepared at one side of the pick-up position 5 may be also disposed on a new stacking support 18 and carriage 19.

The stacking support 18 with the new stack 17 of blanks may be displaced towards the pick-up position 5 at the same time as the empty stacking support 7 is removed from said position. The buffer 16 held by the buffer robots 10*a*, 10*b*, 10*c*, 10*d*, from which the loading robot 6 is picking the blanks during this operation, doesn't hinder the movement of the stacking support 18 with the new stack 17, because it is maintained above the level of the stack 17.

Figure 3:
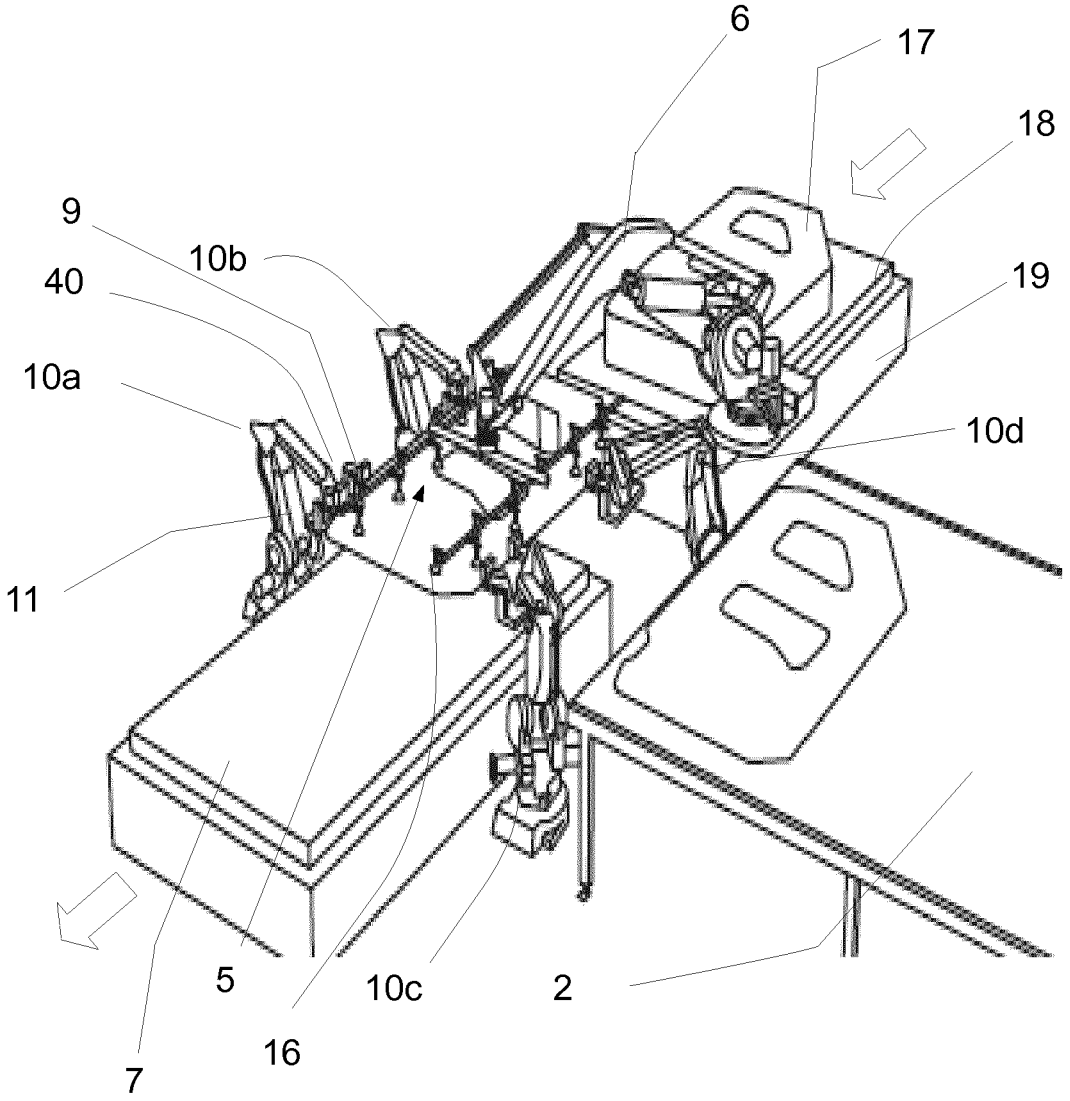
FIG. 3 is a perspective view of the loading station of FIGS. 1 and 2, showing the stack of blanks being replaced.

FIG. 3 shows the loading station with the stacking support 7 almost removed from the pick-up position 5 and the stacking support 18 with the new stack 17 of blanks moving towards the pick-up position. The buffer robots 10*a*, 10*b*, 10*c*, 10*d* are holding the buffer 16 of blanks by the supporting tools 11, which are in extended position. The figure shows the loading robot 6 with its tooling 9 picking a blank from the buffer 16. The separating tools 13 may operate on the blanks of the buffer 16 to facilitate their picking by the loading robot, in the same way as they operate on the blanks when they are on a stacking support.

Figure 4:
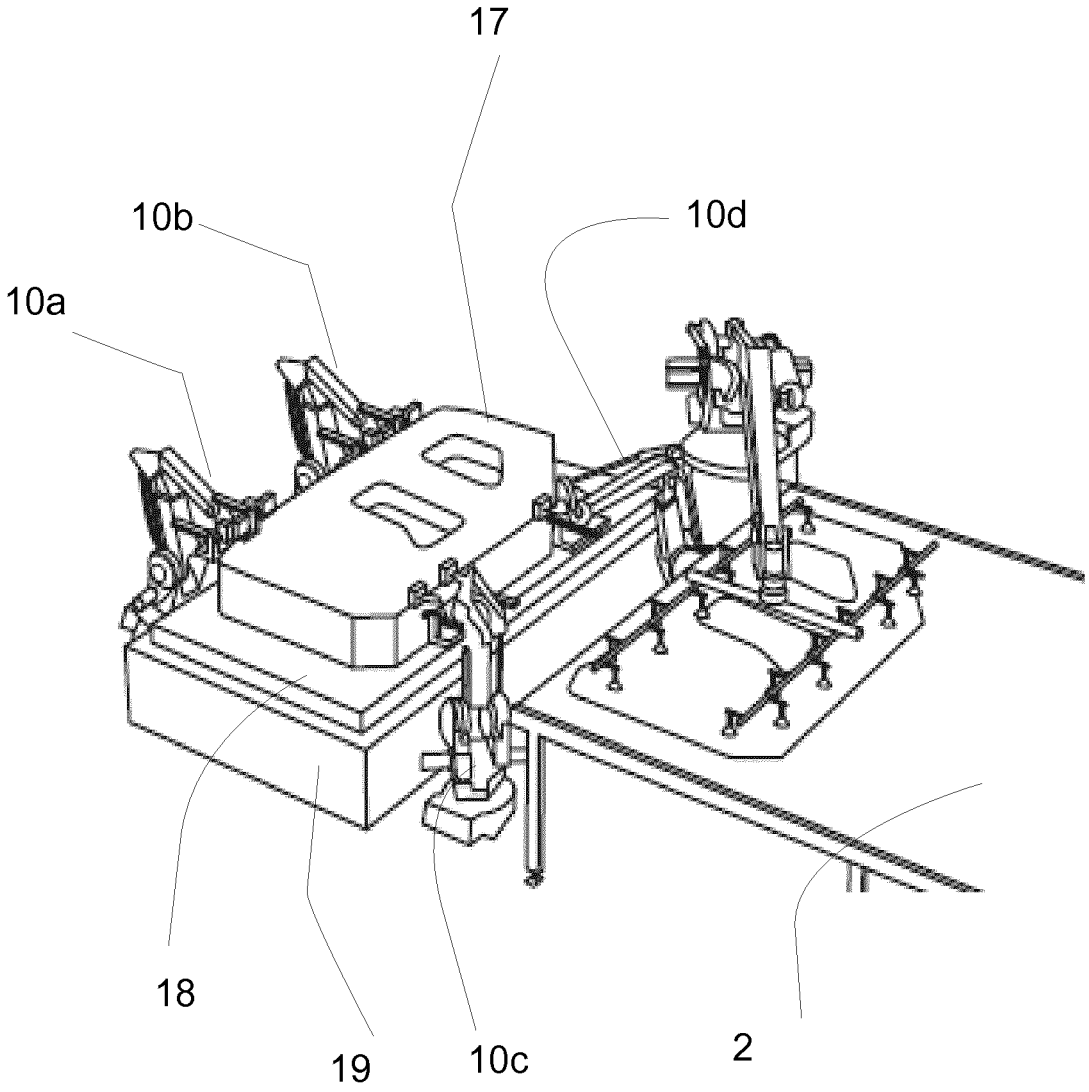
FIG. 4 is a perspective view of the loading station of FIGS. 1, 2 and 3 showing the handling system picking up the last blank of the buffer.

FIG. 4 shows the new stack 17 is in the pick-up position 5 and the loading robot 6 has picked the last blank of the buffer 16 the buffer robots 10*a*, 10*b*, 10*c*, 10*d* are lowered again and the supporting tools 11 are withdrawn to the retracted position, such that the handling system goes back to the position of FIG. 1 and the loading robot 6 starts picking blanks from the new stack 17 of blanks, such that the loading operation may continue without any stop.

In alternative implementations of the method, the buffer of blanks may be created by supporting tools that are not attached to the same robots as the blanks separating tools, but independent. They may be attached to dedicated buffer robots, or operated in a different way. When only a predetermined number of blanks remain in the stack, these independent supporting tools may be operated to create the buffer, and after the buffer is exhausted, the supporting tools may be withdrawn until the next buffer has to be created.

It has to be noted that in FIGS. 1-4 the buffer robots and the loading robots are shown only very schematically. The structure, details and operating parameters of the buffer robots and the loading robot are known by the person skilled in the art, who will be able to employ both types of robots with the most suitable features for any particular application. For example, the robots may be 4-axes or 6-axes, the layouts of the buffer robots may be decided on the basis of the position of the wrist may adopt and/or the space available in each particular application.

Figure 5:
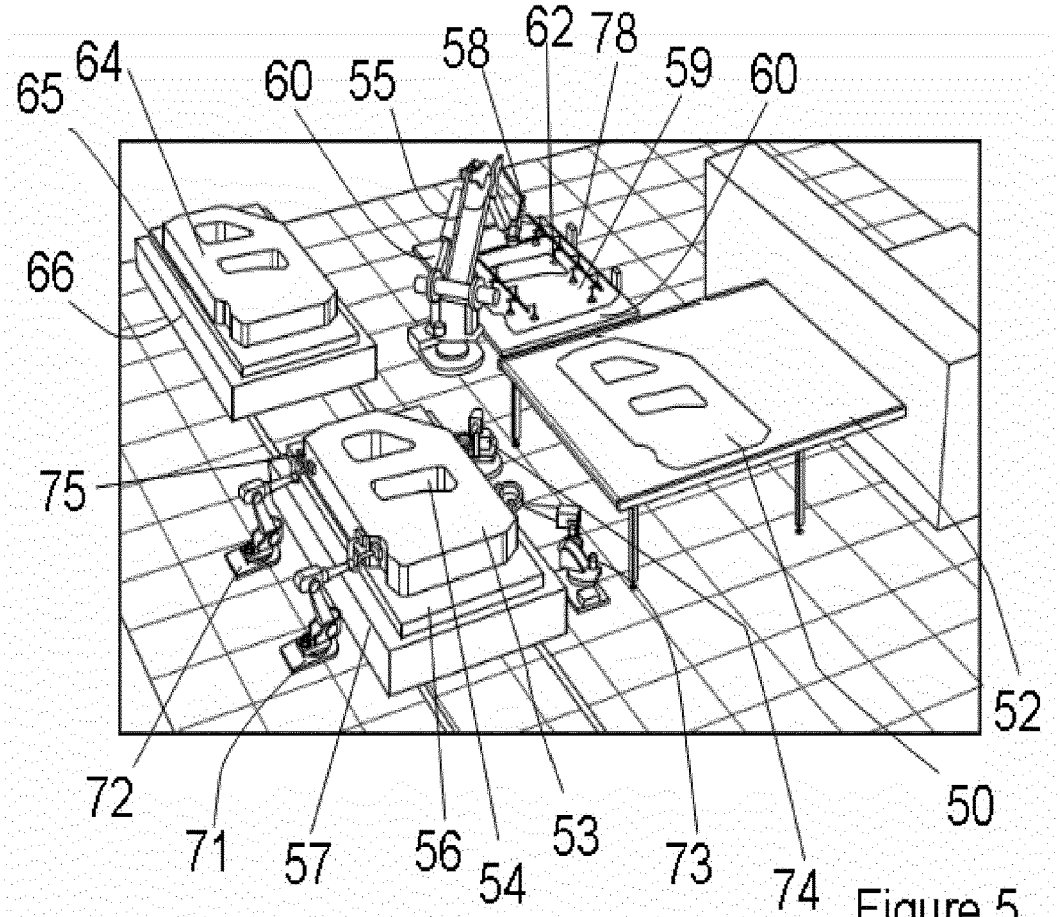
FIG. 5 is a perspective view of a loading station of a head of a stamping press line with a first implementation of a handling system for creating a buffer from a stack of blanks.

FIG. 5 is a perspective view of a handling system according to an implementation hereof, in a loading station of a head of a stamping press line.

More particularly, FIG. 5 shows very schematically a head of a stamping press line 52, such as a press line, which may receive a blank 50 from a stack 53 of blanks located at a pick-up position 54.

A loading robot 55, for example a suitable industrial robot, may pick up the blank at the top of the stack 53 and feed it to the head of the stamping press line 52.

In this example, the stack 53 of blanks may be one stack of blanks although some other options may be possible. For example, the stack of blanks may be formed with a plurality of stacks of blanks. In this way, the plurality of stacks of blanks may be situated on the stacking support. The plurality of stacks of blanks may be situated parallel to each other in the direction of the flow of the press stamping line although some geometrical distributions may be possible. In the particular case of two stacks of blanks, the operation of the systems may be described as follows: the loading robot 55 may pick up a first blank situated at the top of the first stack of blanks and a second blank situated at the top of the second stack blanks simultaneously. The stamping press line may be fed with the first and second blanks at the same time, thus the feed rate of the line may be increased.

The stack 53 of blanks may be located on a stacking support 56 configured to hold the stack of blanks. The stacking support 56 is shown only schematically in the figures, and may be of any known type.

The stacking support 56 may include a carriage 57 that may be displaceable along a track (not shown). The carriage 8 may be driven by a linear motor (not shown) but other options may be possible. The stacking support 56 may be provided with a load detector (not shown) to detect that the stack 53 of blanks is exhausted, or that only a predetermined number of blanks remain.

The loading robot 55 may be provided with four axes or six axes. The loading robot may have a wrist mount 58 located at its distal end. A tooling 59 e.g. with magnet or suction cups suitable for handling the blank may be attached to the wrist mount 58. The loading robot 55 may be mounted on the floor but some other configurations may be possible, e.g. roof mounted.

The loading robot 55 may be controlled by a controller (not shown) to pick up the blank 50 from the stack of blanks 53 and load it on the head of the stamping press line 52.

Figure 6:
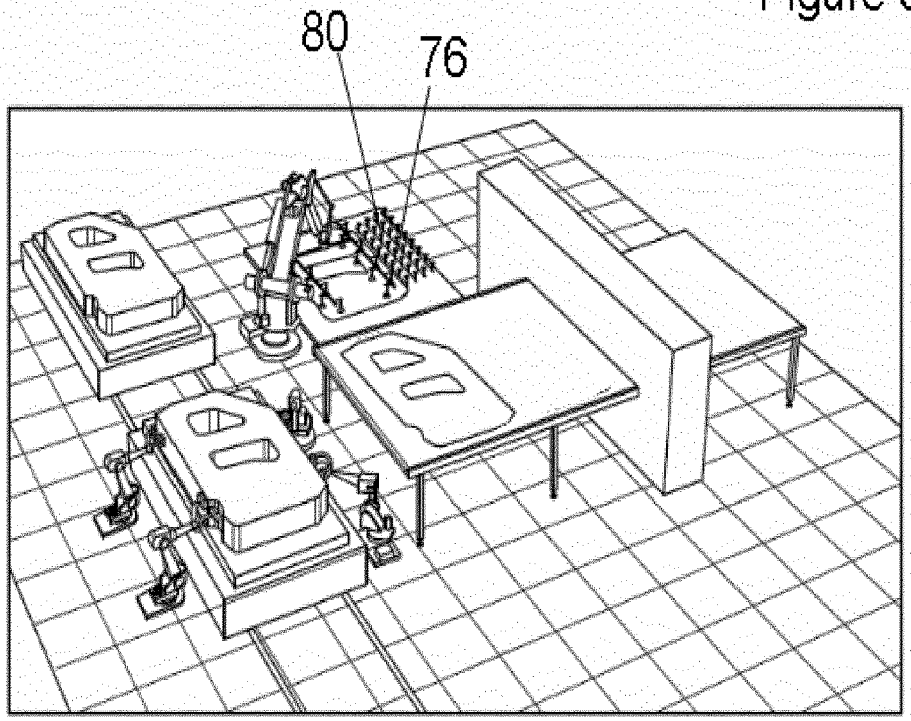
FIG. 6 is a perspective view of a loading station of a head of a stamping press line with a second implementation of a handling system for creating a buffer from a stack of blanks.

An example of a loading robot that may be employed in the loading station of FIGS. 5 and 6 is robot IRB 6660 or IRB 760, available from ABB (www.abb.com), among others.

The pick-up position 54 from where the blanks 50 may be picked may be located aligned with the head of the stamping press line 52, as shown, but other pick-up positions may be possible.

A plurality of separating robots 71, 72, 73, 74 may be provided. The plurality of separating robots may be provided with one or more separating mechanisms 75.

A buffer holder 60 may be provided. The buffer holder 60 may be configured to hold one or more blanks. In some examples, the buffer holder may be configured to hold one or more stacks of blanks. The buffer holder may be provided with one or more separating tools 78 e.g. a magnetic device. The magnetic device creates a magnetic field, thus the blank situated on the top of the stack may be slightly separated from the underlying blank of a stack of blanks forming the buffer. The blanks suitable for the magnetic device may be made of a magnetic material e.g. steel. In the particular case of a plurality of stacks of blanks located on the buffer holder, additional separation tools may be needed.

The buffer holder may be located next to the head for the stamping press line although some other locations of the buffer holder may be possible e.g. above the head of the stamping press line with no interference with the loading robot dropping blanks.

The separating tools may be a magnetic device as described above although some other options may be possible e.g. a structure with supporting surfaces or vacuum cups as illustrated in the FIG. 6.

The operation of the system may be described as follows. The loading robot 55 may pick up blanks from the stack of blanks 53 located at a pick-up position 54. The separating robots 71, 72, 73, 74 may have the separating mechanism activated, thus the blank situated on the top of the stack 53 of blanks may be maintained slightly separated. The loading robot 55 may pick up the blanks from the top of the stack 53, and the head of the stamping press line 52 may be fed.

As blanks are removed from the stack 53, and unless the stacking support 56 is provided with a lift, the height of the stack 53 will decrease; the buffer robots 71, 72, 73, 74 may then progressively adjust the position of the separating mechanisms 75 to the stack height.

The number of blanks remaining on the stack 53 may be controlled, for example by a load detector (not shown); alternatively, the number or remaining blanks may be determined depending on the height of the buffer robots 71, 72, 73, 74, because these robots place the separating mechanisms adjacent the blank at the top of the stack, so their height at any time depends on the number of remaining blanks.

During the operation of the system, the loading robot 55 may have a time-out. The time-out may be defined as a period of time when the loading robot may stop feeding the head of the stamping press line (due to the fact that the head of the press line has enough blanks to work properly). Consequently, the loading robot 55 may be operated to feed the buffer holder 60 during one or more time-outs by picking-up and situating a blank from the stack 53 of blanks on the buffer holder 60, thus the formation of the buffer 62 of blanks on the buffer holder 60 may be achieved.

In this way, the loading robot 55 may create a buffer 62 of blanks from which the loading robot 55 may pick up blanks to feed the head of the stamping press line 52 while the stacking support 56, where no blanks remain, is displaced from the pick-up position 54.

The empty stack of blanks may be replaced with a new stack 64 of blanks, which in this figure is shown prepared at one side of the pick-up position 54. The new stack of blanks 64 may be also disposed on a new stacking support 65 and carriage 66.

The stacking support 65 with the new stack 64 of blanks may be displaced towards the pick-up position 54 at the same time as the empty stacking support 56 is removed from said position. During this operation, the loading robot 55 is picking blanks to feed the head of the stamping press line from the buffer of blanks 62. The buffer of blanks 62 may be formed as described above.

The FIG. 6 is a perspective view of a loading station of a head of a stamping press line with an implementation of a handling system for creating a buffer from a stack of blanks. In this figure same numbers denote the same elements as in FIG. 5. The structure and operation of the system may be the same as described in the FIG. 5.

In this particular implementation, a buffer holder 60 may be provided. The buffer holder 60 may be configured to hold one or more blanks. In some examples, the buffer holder may be configured to hold one or more stacks of blanks. The buffer holder may be provided with one or more separating tools e.g. vacuum cups 76. The vacuum cups 76 may be located on a structure 80 e.g. a metallic structure. The structure 80 may have a one or more supporting surfaces. The vacuum cups 76 may be situated forming one or more lines on the supporting 80 e.g. four lines of vacuum cups. In the particular case of a plurality of stacks of blanks located on the buffer holder, additional separation tools may be needed.

Each line of vacuums may be situated substantially parallel and at a different height with respect to the line next to it. Furthermore, each line may be separate with respect to the line next to it in the horizontal position. This way, an offset in height and the horizontal position between the blanks during their positioning may be achieved.

Accordingly, the blanks placed on the buffer holder 60 during the time-outs as described above may be situated with an offset with respect to each other. When one blank may be picked from the buffer, the vacuum cups of the corresponding line of vacuums (that normally are retaining the blank) may be released, while the remaining lines of vacuums should be kept activated to retain the rest of the blanks. This way, the risk of the underlying blank being displaced when a blank is picked-up may be prevented. In addition blowing air could be used to facilitate the separation.

In some other examples, some other geometrical configurations of the vacuums cups 76 and the structure 80 to hold the vacuum cups may be possible.

The blanks suitable for the vacuum cups may be made of a magnetic material e.g. steel although some other non-magnetic options are also possible e.g. aluminum.

In some other implementation not shown, a buffer holder may be provided. The buffer holder may be configured to hold one or more blanks. The buffer holder may be provided with a separating tool e.g. a metallic structure. The metallic structure may be provided with one or more supporting surfaces e.g. lines or steps. The supporting surfaces may be configured to support one or more blanks. The supporting surfaces may be situated substantially parallel and at a different height with respect to the line next to it. Furthermore, each supporting surface may be separated to the supporting surface next to it in the horizontal position.

Accordingly, the blanks placed on the buffer holder during the time-outs as described above may be situated with an offset with respect to each other, therefore, the risk of the underlying blank being displaced when a blank is picked-up may be prevented. In some other examples, some other geometrical configurations of the structure and the supporting surface may be possible.

It has to be noted that in FIGS. 5-6 the separating robots and the loading robots are shown only very schematically. The structure, details and operating parameters of the buffer robots and the loading robot are known by the person skilled in the art, who will be able to employ both types of robots with the most suitable features for any particular application. For example, the robots may be 4-axes or 6-axes, the layouts of the robots may be decided on the basis of the position of the wrist may adopt and/or the space available in each particular application.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

The invention claimed is:

1. A method for loading blanks to a head of a stamping press line comprising:

Providing a stack of blanks at a pick-up position;

Loading blanks from the stack of blanks to the head of the stamping press line;

Before the stack of blanks is exhausted, creating a buffer by raising a predetermined number of blanks from the top of the stack of blanks to a position above the stack of blanks, the raising a predetermined number of blanks being performed by one or more buffer robots, each buffer robot comprising one or more supporting tools on which the blanks can be held, the buffer robots being industrial robots; and Loading blanks from the buffer to the head of the stamping press line while providing a new stack of blanks at the pick-up position.

2. A method according to claim 1, wherein the supporting tool is moved from a retracted position in which it does not interfere with the stack of blanks and an extended position in which it is inserted under one of the blanks of the stack of blanks such that the blanks above the supporting tool rest thereon.

3. A method according to claim 1, further comprising adapting the supporting tools to the shape of the blanks.

4. A method according to claim 1, further comprising maintaining one or more blanks at the top of the stack of blanks separate from the underlying blank of the stack of blanks.

5. A method according to claim 4, wherein maintaining one or more blanks at the top of the stack of blanks separate from the underlying blank is performed by a separating tool.

6. A method according to claim 5, wherein the separating tool is a magnetic device arranged on one or more buffer robots.

7. A method according to claim 5, wherein the separating tool is a device configured to apply a mechanical friction force in an upward direction on the upper edge of a blank.

8. A handling system for creating a buffer from a stack of blanks, comprising one or more buffer robots, the buffer robots being industrial robots, each buffer robot comprising:

one or more supporting tools on which the blanks can be held, and one or more separating tools configured to separate one or more blanks at the top of the stack of blanks from the underlying blank of the stack of blanks;

the one or more buffer robots configured to create a buffer by raising a predetermined number of blanks from the top of the stack of blanks to a position above the stack of blanks.

9. A handling system according to claim 8, wherein the one or more supporting tools are movable from a retracted position in which they do not interfere with the stack of blanks and an extended position in which they are inserted under one of the blanks of the stack of blanks such that the blanks above the supporting tool rest thereon.

10. A handling system according to claim 9, wherein one or more of the supporting tools are configured to be adapted to the shape of the blanks.

11. A handling system according to claim 9, wherein each supporting tool comprises a housing mounted on the buffer robot, at least one arm or rod which is slidably mounted with respect to the housing between the retracted and the extended position, and a drive system to displace the arm or rod between said two positions.

12. A handling system according to claim 11, wherein each supporting tool is provided with two substantially parallel arms or rods.

13. A handling system according to claim 8, comprising two or more buffer robots.

14. A handling system according to claim 8, comprising four buffer robots.

15. A handling system according to claim 8, wherein the separating tool comprises a magnetic device.

16. A handling system according to claim 8, wherein the one or more supporting tools are mounted on a buffer robot below the separating tool.

17. A handling system for creating a buffer from a stack of blanks, comprising a loading robot;

a buffer holder configured to receive one or more blanks, wherein the buffer holder comprises one or more separating tools configured to separate one or more blanks at the top of the stack of blanks from the underlying blank of the stack of blanks.

18. A handling system according to claim 17, wherein the one or more separating tools comprise a magnetic device.

19. A handling system according to claim 17, wherein the one or more separating tools comprise one or more supporting surfaces configured to receive a plurality of blanks and situated substantially parallel and at a different height with respect to each other.

* * * * *